US007249485B2

(12) United States Patent
Honda et al.

(10) Patent No.: US 7,249,485 B2
(45) Date of Patent: Jul. 31, 2007

(54) SUBSTRATE PROCESSING APPARATUS

(75) Inventors: Yuji Honda, Ebina (JP); Katsuhiro Nagasawa, Ebina (JP)

(73) Assignee: Hitachi Via Mechanics, Ltd., Ebina-shi (JP)

( * ) Notice: Subject to any disclaimer, the term of this patent is extended or adjusted under 35 U.S.C. 154(b) by 519 days.

(21) Appl. No.: 10/935,218

(22) Filed: Sep. 8, 2004

(65) Prior Publication Data

US 2005/0115796 A1 Jun. 2, 2005

(30) Foreign Application Priority Data

Dec. 1, 2003 (JP) ..... 2003-401713

(51) Int. Cl.
*B21J 13/10* (2006.01)

(52) U.S. Cl. ..... 72/420; 72/421; 226/55

(58) Field of Classification Search ..... 72/335, 72/405.05, 405.06, 405.09, 482.91, 482.92, 72/419, 420, 421, 422; 226/2, 3, 52, 55, 226/58, 74; 198/339.1, 345.1, 345.2, 345.3
See application file for complete search history.

(56) References Cited

U.S. PATENT DOCUMENTS 5,779,125 A * 7/1998 Melzer et al. ..... 226/55
5,950,484 A * 9/1999 Kutschker ..... 72/420
6,065,325 A * 5/2000 Tsai ..... 72/424
6,145,424 A * 11/2000 Matsuda et al. ..... 83/227
6,460,387 B1 * 10/2002 Seto ..... 72/3

FOREIGN PATENT DOCUMENTS

JP 2000-246479 9/2000

* cited by examiner

*Primary Examiner*—Ed Tolan
(74) *Attorney, Agent, or Firm*—Crowell & Moring LLP

(57) ABSTRACT

Substrate processing apparatus for processing holes accurately positioned in an long film, comprising: work supporting devices for supporting the work; clamping devices for clamping the work onto the work supporting devices; first movement devices for moving the work supporting devices in the transferring direction of the work; guiding devices for guiding the work supporting devices; guide supporting devices for supporting these guiding devices; and second movement devices for moving the guide supporting devices in the direction perpendicular to the transferring direction of the work, wherein two pins or holes are disposed on or in each of the guiding devices, holes or pins to engage with the pins or holes are disposed on or in each of the guide supporting devices to combine the guiding devices and guide supporting devices in a grid form, and the holes and pins at four junctions are fitted.

2 Claims, 5 Drawing Sheets

SUBSTRATE PROCESSING APPARATUS

BACKGROUND OF THE INVENTION

1. Field of the Invention

The present invention relates to a substrate processing apparatus for transferring a sheet-shaped work and processing it for every predetermined length.

2. Description of the Related Art

As disclosed in JP-A-2000-246479, there is a laser drilling machine which repeats the steps of clamping onto a processing table a part of a long strip of film wound in a roll, subjecting it to required processing by relative movement between the processing table and a drilling tool in horizontal XY directions, afterwards rolling up only the length of the processed part of the long film and processing the next part that is not yet processed.

If the long film does not displace in widthwise direction perpendicular to the film feeding direction, the aforementioned machine can accomplish accurate hole-positioning.

However, there is a gap between the roll and a support holding the roll. Moreover, the long film is not always wound at a right angle to the roll axis. Therefore, the direction of the unrolled long film will be inclined relative to the X or Y axis of the processing table, which deteriorates the hole positioning accuracy.

BRIEF SUMMARY OF THE INVENTION

An object of the present invention is to solve the problems in the related art described above and to provide a substrate processing apparatus capable of improving the processing accuracy even where the axis of the unrolled long film is inclined relative to the X or Y axis of the processing table.

In order to achieve the object stated above, according to the invention, there is provided a substrate processing apparatus for processing a sheet-shaped work while transferring it; comprising a pair of work supporting means for supporting the work in the vertical direction, clamping means for clamping the work with the work supporting means, first movement means for moving the work supporting means in the lengthwise direction of the work, a pair of guiding means for guiding the work supporting means, a pair of guide supporting means for supporting these guiding means, and a pair of second movement means for moving the guide supporting means in a perpendicular direction to the lengthwise direction of the work, wherein two pins or holes are disposed on or in each of the guiding means, holes or pins to engage with the pins or holes are disposed on or in each of the guide supporting means to combine the guiding means and guide supporting means in a grid form, and the holes and pins at the four junctions are fitted with substantially no gaps between them.

The processing accuracy can be improved over the whole processed area of the work because any inclination of the work W is corrected in advance of processing, except when setting the work W.

DETAILED DESCRIPTION OF THE INVENTION

A preferred embodiment of the present invention will be described below with reference to the accompanying drawings.

Figure 1:
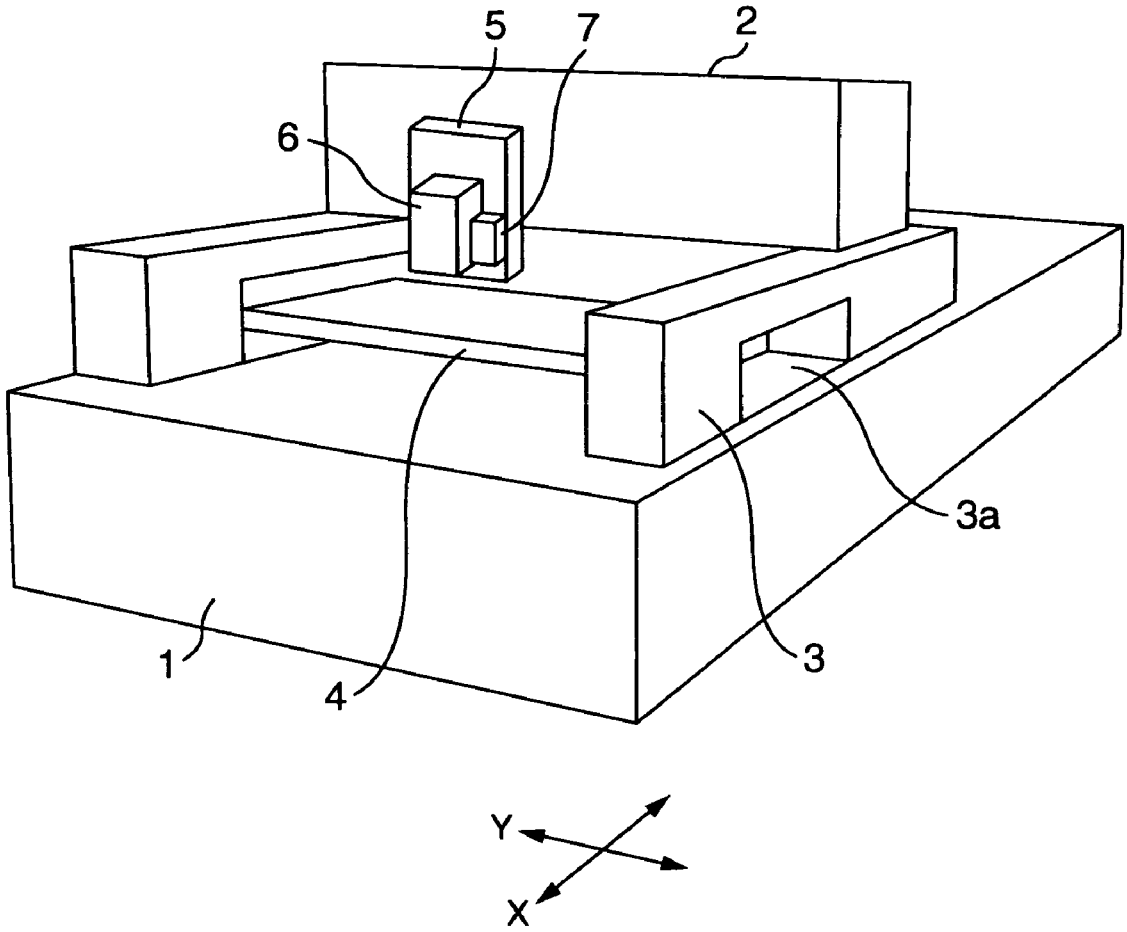
FIG. 1 schematically shows an overall view of a substrate processing apparatus according to the present invention.

FIG. 1 schematically shows an overall view of a substrate processing apparatus according to the invention.

A column base 3 is fixed to a base 1. A column 2 can move over the column base 3 in the direction of the X axis. A main shaft 6 and a camera 7 is held by a slide base 5 that can move over the column 2 in the direction of the Y axis.

A table 4 is fixed to the base 1. A rolled sheet-shaped work to be described afterwards is supplied to the table 4 through a window 3*a* disposed in the column base 3.

Next will be described a transferring section for the work.

Figure 2:
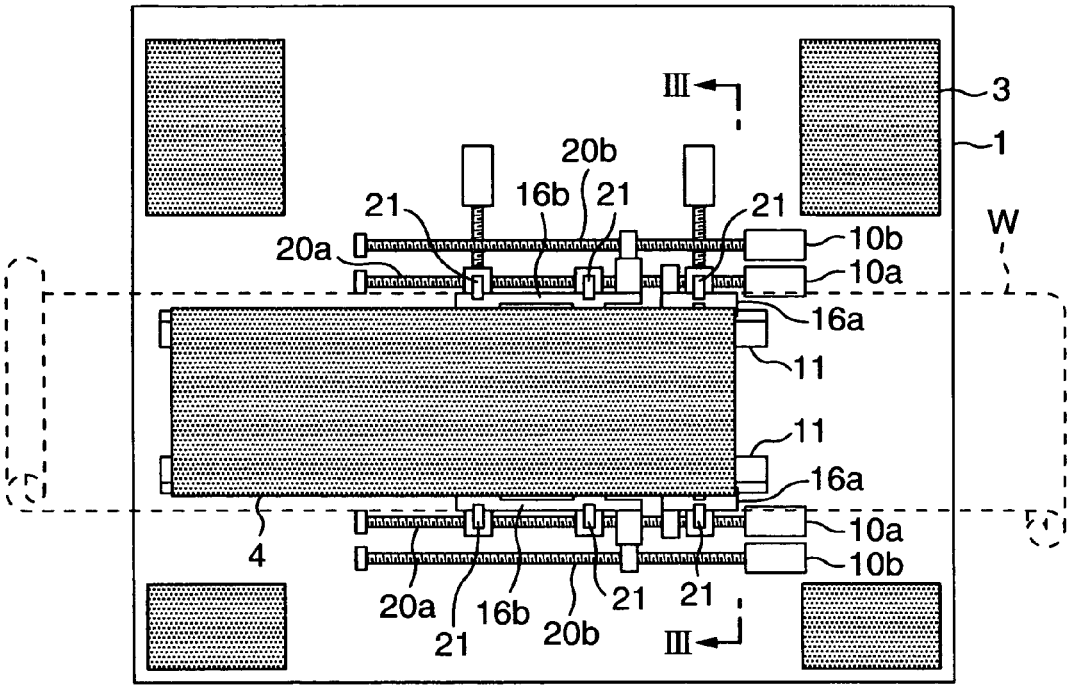
FIG. 2 is a plan view of a part around a table in the substrate processing apparatus according to the invention.
Figure 3:
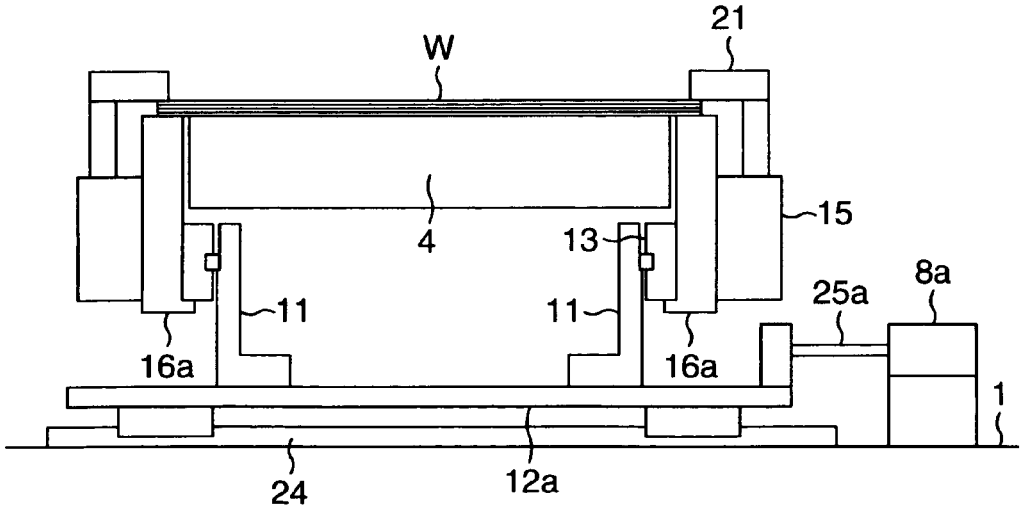
FIG. 3 is a section view taken along a line III-III in FIG. 2.
Figure 4:
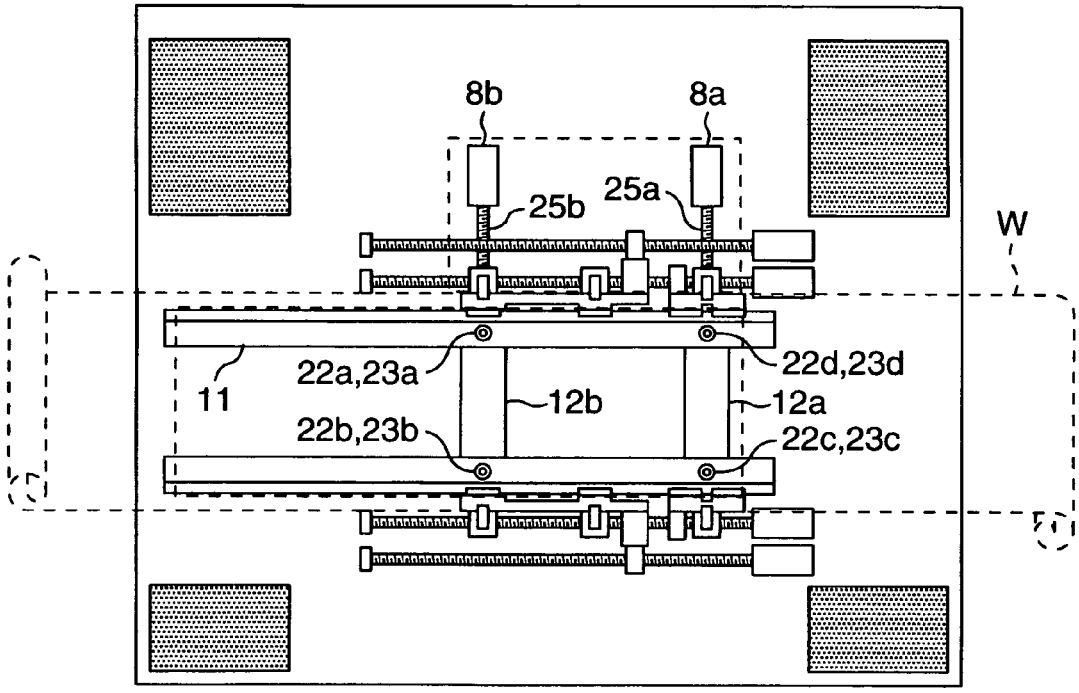
FIG. 4 is a plan view of a part around a table in FIG. 2 with the table taken away.

FIG. 2 shows a plan view of a part around a table in the substrate processing apparatus according to the invention; FIG. 3, a section view taken along a line III-III in FIG. 2; and FIG. 4, a plan view of the part around the table in FIG. 2 with the table taken away.

By both sides of the table 4 a pair of clamp bases 16*a* and a pair of clamp bases 16*b* are arranged in the Y axis direction. The clamp bases 16*a* and 16*b* can independently move on a pair of guide bases 11 with linear guide devices 13. Incidentally, the positions shown in FIG. 2 are the standby positions for the clamp bases 16*a* and 16*b*.

Two sets of a motor 10*a* and a ball screw 20*a* each cause the clamp bases 16*a* to move in the direction of the Y axis. Two sets of a motor 10*b* and a ball screw 20*b* each cause the clamp bases 16*b* to move in the direction of the Y axis.

One clamper 21 is supported on a flank of one of the clamp bases 16*a*, and two clampers 21 are supported by a flank of one of the clamp bases 16*b*. The clampers 21 can be moved vertically by cylinders 15. The top faces of the clamp bases 16*a* and 16*b* are at the same level or slightly higher than the top face of the table 4.

Guide bases 11 are mounted on a pair of positioning bases 12*a* and 12*b*. The guide bases 11 are positioned by fitting holes 22*a* through 22*d* bored in the guide bases 11 onto four pins 23*a* through 23*d* fixed to the positioning bases 12*a* and 12*b*. While there is substantially no gap between the hole 22*a* and the pin 23*a*, the holes 22*b* through 22*d* are slightly larger than the diameters of the pins 23*b* through 23*d* (e.g. 0.5 mm larger in diameter).

The positioning bases 12*a* and 12*b* can independently move over the base 1 in the direction of the X axis with linear guide devices 24. A motor 8*a* and a ball screw 25*a* cause the positioning base 12*a* to move in the direction of the X axis. A motor 8*b* and a ball screw 25*b* cause the positioning base 12*b* to move in the direction of the X axis.

Next will be described the operation of this embodiment of the invention.

Figure 5A:
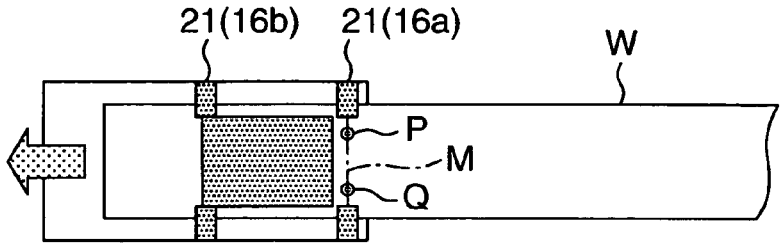
FIGS. 5A to 5F illustrate how a work W is positioned according to the invention.
Figure 5B:
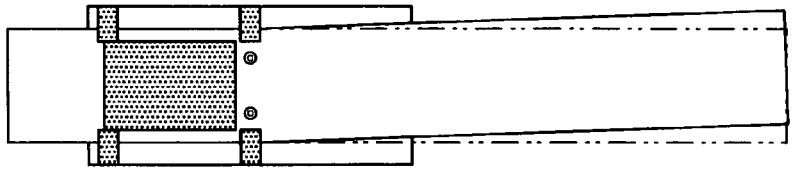
Figure 5C:
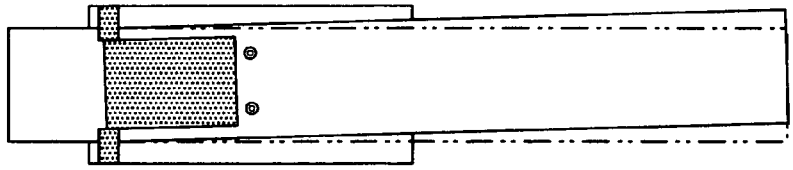
Figure 5D:
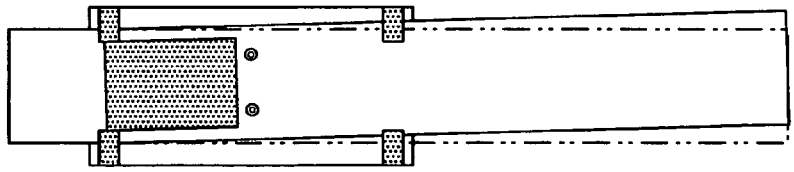
Figure 5E:
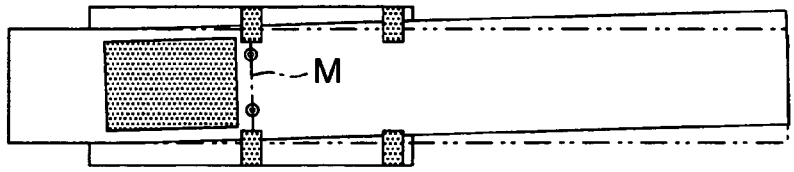
Figure 5F:
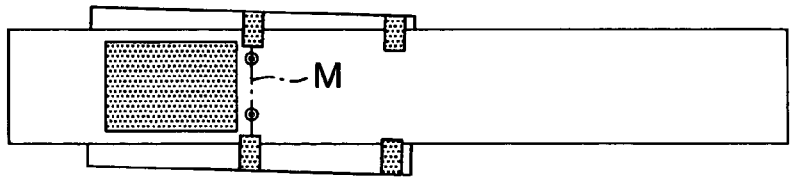
Figure 6A:
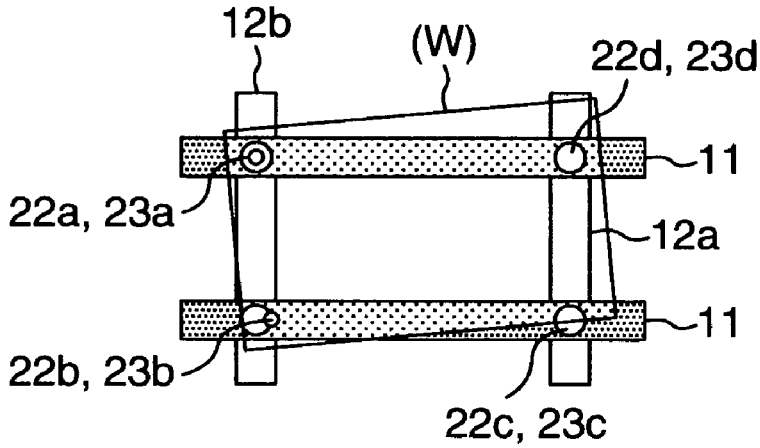
FIGS. 6A and 6B illustrate how guide bases 11 are positioned according to the invention.
Figure 6B:
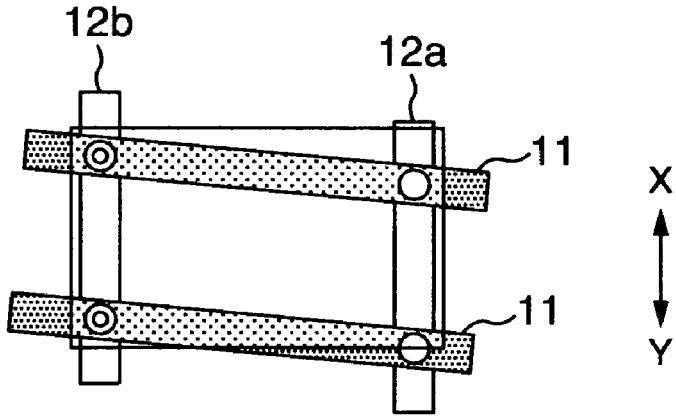

FIGS. 5A through 5F illustrate how a work W is positioned, and FIGS. 6A and 6B, how the guide bases 11 are positioned.

Incidentally, the guide bases 11 are set in parallel to the Y axis in advance, and the clamp bases 16*a* and 16*b* are placed in their respective standby positions.

(1) The axis of the work W is positioned at the center of the processing area and in parallel to the Y axis, and the work W is fixed to the clamp bases 16*a* and 16*b* with the clampers 21.

(2) In this state, two reference holes P and Q are bored into the work W (FIG. 5A). A straight line M between the centers of the reference holes P and Q is parallel to the X axis.

(3) The motors 10*a* and 10*b* are operated, and the next work part is positioned in the processing area (FIG. 5B).

(4) The clampers 21 of the clamp bases 16*a* are disengaged and returned to those standby positions. If the work W is inclined, the removal of the clampers 21 from the clamp bases 16*a* causes the work to rotate around the clampers 21 of the clamp bases 16*b* (in the illustrated case, it is rotated upwardly from the right) (FIG. 5C).

(5) The clampers 21 of the clamp bases 16*a* are downed and fixed. As a result, the axis of the work W is clamped by the clamp bases 16*a* in the inclined state (FIG. 5D).

(6) The clampers 21 of the clamp bases 16*b* are disengaged and returned to those standby positions.

(7) The clampers 21 of the clamp bases 16*b* are downed and fixed (FIG. 5E).

Now is completed the operation to position the new part to be processed in the work W relative to the main shaft 6. However, the position of the reference hole P is shifted from the processing reference position according to the design, and the line M is inclined relative to the X axis.

To compensate for this deviation, the position of the work W is corrected as follows.

(8) The motors 8*a*, 8*b*, 10*a* and 10*b* are operated while referring to the position of the reference hole P by the camera 7, and the reference hole P is placed in its processing reference position according to the design. Additionally, in this step, the clamp bases 16*a* and 16*b* are so moved as to maintain their parallelism (FIG. 6A).

(9) The motor 8*a* is operated in a state in which the motor 8*b* is at halt, and the reference hole Q is placed in its processing reference position according to the design (FIG. 6B). As a result, as shown in FIG. 5F, the line M is made parallel to the X axis and the axis of the work W is made parallel to the Y axis.

(10) In this state, the reference holes P and Q are bored into the work W (FIG. 5A).

(11) The work W is processed.

Thereafter, the procedure of (3) through (11) is repeated until the processing of the work W is completed.

Moreover, although the gaps between the holes 22*b* through 22*d* and the pins 23*b* through 23*d* are made larger than the gap between the hole between the hole 22*a* and the pin 23*a* in this embodiment, the holes 22*b* through 22*d* and the pins 23*b* through 23*d* can as well be smaller, equal to the gap between the hole 22*a* and the pin 23*a*. In this case, the clamp bases 16*a* and 16*b* will be elastically deformed and twisted, but this will pose no problem in practical use because the corrected quantity is small.

The invention claimed is:

1. A substrate processing apparatus for processing a sheet-shaped work while transferring it, comprising:

work supporting means for supporting said work in a vertical direction;

clamping means for clamping said work onto said work supporting means;

first movement means for moving said work supporting means in the transferring direction of said work;

guiding means for guiding said work supporting means;

guide supporting means for supporting these guiding means; and second movement means for moving said guide supporting means in a direction perpendicular to the transferring direction of said work, wherein two pins or holes are disposed on or in each of said guiding means, holes or pins to engage with said pins or holes are disposed on or in each of said guide supporting means to combine said guiding means and guide supporting means in a grid form, and the holes and pins at four junctions are fitted with substantially no gaps between them.

2. A substrate processing apparatus, as claimed in claim 1, wherein the fitting of said hole and said pin at one of said four junctions is made with substantially no gap between them, and the fitting at the other three junctions is allowed larger gaps.

* * * * *